US008608910B2

(12) United States Patent
Yoshiyama et al.

(10) Patent No.: US 8,608,910 B2
(45) Date of Patent: Dec. 17, 2013

(54) COAL REFORMING APPARATUS

(75) Inventors: Ryuji Yoshiyama, Tokyo (JP); Setsuo Omoto, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 916 days.

(21) Appl. No.: 12/749,997

(22) Filed: Mar. 30, 2010

(65) Prior Publication Data

US 2011/0236516 A1 Sep. 29, 2011

(30) Foreign Application Priority Data

Mar. 24, 2010 (JP) ..... 2010-068065

(51) Int. Cl.
*C10B 9/00* (2006.01)
*F26B 5/04* (2006.01)

(52) U.S. Cl.
USPC ..... 202/96; 202/129; 202/228; 202/262; 34/404

(58) Field of Classification Search
USPC ..... 202/96, 129, 228, 262; 44/280, 592, 44/593, 595, 596, 598, 599; 34/404
See application file for complete search history.

(56) References Cited

U.S. PATENT DOCUMENTS

| | | | | |
|---|---|---|---|---|
| 4,645,513 | A | 2/1987 | Kubota et al. | |
| 4,854,937 | A * | 8/1989 | Meyer et al. | 44/280 |
| 5,556,436 | A * | 9/1996 | Yagaki et al. | 44/626 |
| 6,162,265 | A * | 12/2000 | Dunlop et al. | 44/626 |
| 6,558,441 | B1 * | 5/2003 | Sato | 44/608 |
| 8,197,561 | B2 * | 6/2012 | Dunlop et al. | 44/620 |
| 8,252,070 | B2 * | 8/2012 | Sugita et al. | 44/282 |

FOREIGN PATENT DOCUMENTS

| | | | |
|---|---|---|---|
| CN | 101243164 | A | 8/2008 |
| CN | 101613615 | A | 12/2009 |
| DE | 31 48 762 | A1 | 10/1982 |
| GB | 2085917 | * | 5/1982 |
| JP | 63-218797 | A | 9/1988 |
| JP | 63-67518 | B2 | 12/1988 |
| JP | 07-233383 | A | 9/1995 |
| WO | WO 2007/060852 | * | 5/2007 |
| WO | 2008/072522 | A1 | 6/2008 |

OTHER PUBLICATIONS

Chinese Office Action dated May 6, 2013, issued in corresponding Chinese Patent Application No. 201080033636.6, with English Translation.

International Search Report of PCT/JP2010/056036, date of mailing May 18, 2010, w/ English translation, with Forms PCT/ISA/237 and PCT/ISA/220.

German Office Action dated Jul. 26, 2013, issued in corresponding German Patent Application No. 11 2010 005 413.4, with English translation (10 pages).

* cited by examiner

*Primary Examiner* — Nina Bhat
(74) *Attorney, Agent, or Firm* — Westerman, Hattori, Daniels & Adrian, LLP

(57) ABSTRACT

A coal reforming apparatus includes: a dryer body provided to dry low-quality coal; a pyrolysis body which pyrolyzes the dried coal thus dried; and a briquetter which compression-molds the pyrolyzed coal thus pyrolyzed. The coal reforming apparatus has a radical scavenger supplier which supplies drying gas with a radical scavenger so that the low-quality coal can be dried in an atmosphere containing the radical scavenger, the drying gas being supplied from a drying gas supply source and heated by a heater, the radical scavenger being formed of an organic compound having a hydroxyl group.

5 Claims, 3 Drawing Sheets

COAL REFORMING APPARATUS

TECHNICAL FIELD

The present invention relates to a coal reforming apparatus. The present invention is particularly effective when applied to reformation of low-grade coals (low-quality coal) which are porous and contain a large amount of moisture, such as lignite and sub-bituminous coal.

BACKGROUND ART

There are abundant reserves of low-grade coals (low-quality coals) which are porous and which contain much moisture such as lignite, sub-bituminous coal, and the like. Since such low-quality coal has a low heating value per unit weight and has poor transport efficiency, the low-quality coal is heated and dried to increase the heating value per unit weight, and is compression-molded to improve the handling capability.

Meanwhile, the above-described low-quality coal which has been subjected to the heating process is likely to react with water to form a hydrate. In addition, the low-quality coal is likely to react with oxygen in the air because it has an increased surface activity after generation of radicals or the like caused by release of the carboxyl group or the like from the surface. This leads to a possibility of spontaneous ignition due to a reaction heat generated in the reactions.

For this reason, Patent Literature 1 below and the like propose production of reformed coal in which the spontaneous ignition is suppressed in the following manner. Specifically, low-quality coal is added to mixture oil obtained by mixing heavy oil with solvent oil, followed by heating (100° C. to 250° C.), so that the moisture in the coal is vaporized from pores thereof. In addition, after the mixture oil enters the pores, the solid part is separated from the liquid part and then dried. Thereby, the entire surface of the solid part, including the pores therein, is coated with the mixture oil to be shielded from the outside air.

CITATION LIST

Patent Literature

{Patent Literature 1} Japanese Patent Application Publication No. Hei 7-233383

SUMMARY OF INVENTION

Technical Problem

However, in the conventional method described in Patent Literature 1 and the like, when the mixture oil coating the low-quality coal comes off due to an impact or the like, the portion where the mixture oil has come off is exposed to the outside air. This leads to the possibility of spontaneous ignition.

Under these circumstances, the present invention is intended to provide a coal reforming apparatus capable of producing reformed coal in which the possibility of spontaneous ignition is reliably suppressed.

Solution to Problem

A coal reforming apparatus according to a first aspect of the present invention in order to solve the above-described problem is a coal reforming apparatus including: drying means for drying coal; pyrolysis means for pyrolyzing the dried coal; compression-molding means for compression-molding the pyrolyzed coal, and first radical-scavenger supply means for supplying an atmosphere in the drying means with a radical scavenger containing an organic compound having a hydroxyl group, so that the coal is dried in the atmosphere containing the radical scavenger.

A coal reforming apparatus according to a second aspect of the present invention is the coal reforming apparatus according to the first aspect of the present invention, in which the drying means includes: a body an inside of which is supplied with the coal; and drying-gas supply means for supplying the inside of the body with heated drying gas, and the first radical-scavenger supply means includes the radical scavenger therein, and supplies the drying gas with the radical scavenger so that the drying gas from the drying-gas supply means contains the radical scavenger in a gas state.

A coal reforming apparatus according to a third aspect of the present invention is the coal reforming apparatus according to the first aspect of the present invention, in which the drying means includes: a body an inside of which is supplied with the coal; and drying-gas supply means for supplying the inside of the body with heated drying gas, and the first radical-scavenger supply means includes first pyrolysis gas fractionation-supply means for adding at least part of pyrolysis gas to the drying gas, the pyrolysis gas being generated by the pyrolysis means.

A coal reforming apparatus according to a fourth aspect of the present invention is the coal reforming apparatus according to the first aspect of the present invention including second radical-scavenger supply means for supplying an atmosphere in the compression-molding means with the radical scavenger so that the coal is compression-molded in the atmosphere containing the radical scavenger.

A coal reforming apparatus according to a fifth aspect of the present invention is the coal reforming apparatus according to the fourth aspect of the present invention, in which the second radical-scavenger supply means includes second pyrolysis-gas fractionation and supply means for supplying the compression-molding means with at least part of pyrolysis gas generated by the pyrolysis means.

Advantageous Effects of Invention

The coal reforming apparatus according to the present invention enables the following. In the drying process, since the chemically bound water which is hydrogen-bound to the oxygen-containing functional group and the like existing on the entire surface, including pores, of the coal can readily be replaced with the radical scavenger, (1) the dewatering ratio is enhanced significantly; (2) generation of a hydrate is inhibited; and (3) the radical scavenger exists on the entire surface, including the pores, of the coal. Meanwhile, in the pyrolysis process, the radicals which are generated due to the pyrolysis not only on the surface but also inside are scavenged by the radical scavenger and then deactivated. Thus, with the coal reforming apparatus according to the present invention, (1) radicals can be deactivated while allowing few radicals to exist in the coal; (2) generation of additional radicals in the coal can be significantly suppressed; (3) even if new radicals are generated in the coal, they can be deactivated immediately. Therefore, the coal reforming apparatus according to the present invention is capable of readily producing reformed coal in which the possibility of spontaneous ignition is reliably suppressed.

DESCRIPTION OF EMBODIMENTS

Embodiments of a coal reforming apparatus according to the present invention will be described below based on the drawings. However, the present invention is not limited only to the embodiments explained based on the drawings.

First Embodiment

A first embodiment of a coal reforming apparatus according to the present invention will be described based on FIG. 1.

Figure 1:
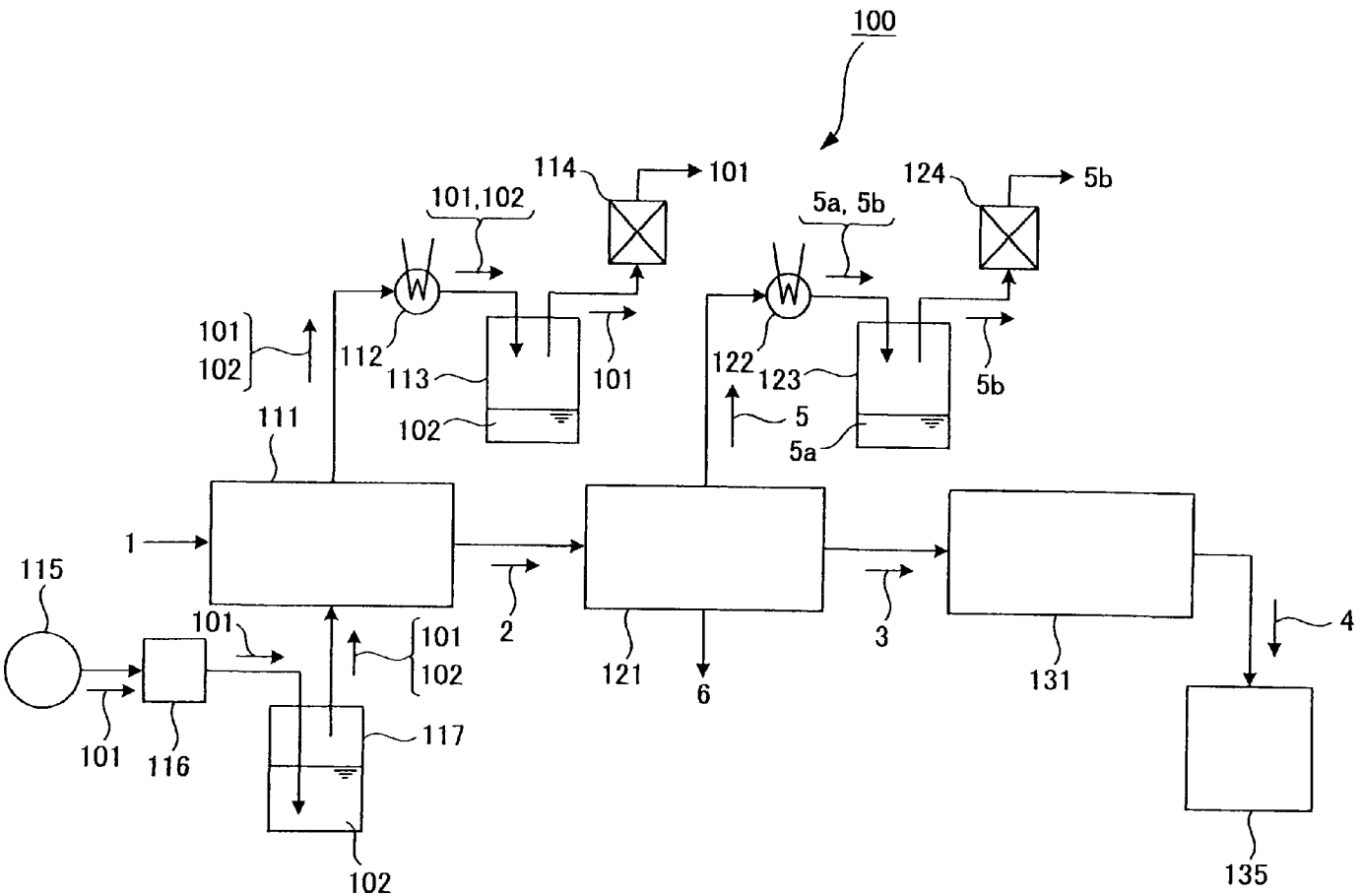
FIG. 1 shows a schematic configuration diagram of a first embodiment of a coal reforming apparatus according to the present invention.

As shown in FIG. 1, a drying gas supply source 115 is connected to a gas inlet port of a dryer body 111 with a heater 116 interposed in between. Low-grade coal (low-quality coal) 1, such as lignite and sub-bituminous coal, which is porous and contains a large amount of moisture, is supplied to the inside of the dryer body 111 from a low-quality coal inlet port thereof. The drying gas supply source 115 supplies the inside of the dryer body 111 with drying gas 101 formed of: an inert gas, such as a nitrogen gas and air. Between the heater 116 and the dryer body 111, a radical scavenger supplier 117 is arranged. The radical scavenger supplier 117 is first radical-scavenger supply means for supplying a radical scavenger 102 so that the drying gas 101 should contain the radical scavenger 102 in a gas state, the radical scavenger 102 being formed of an organic compound having a hydroxyl group (—OH), such as alcohol and phenol, which is likely to react with radicals and is more organophilic than water. A gas outlet port of the dryer body 111 is connected to the outside with a cooler 112, a recovery unit 113 and an absorber 114 interposed in between.

A dried coal inlet port of a pyrolyzer body 121 is connected to a dried coal outlet port of the dryer body 111, the pyrolyzer body 121 pyrolyzing dried coal dried by the dryer body 111. A gas outlet port of the pyrolyzer body 121 is connected to the outside with a cooler 122, a recovery unit 123 and an absorber 124 interposed in between.

A pyrolyzed coal inlet port of a briquetter 131 is connected to a pyrolyzed coal outlet port of the pyrolyzer body 121, the briquetter 131 compressing to mold pyrolyzed coal 3 pyrolyzed by the pyrolyzer body 121 into lumps. A collector container 135 is connected to a molded coal outlet port of the briquetter 131, the collector container 135 collecting molded coal 4 which is compression-molded by the briquetter 131.

Note that, in the present embodiment, the drying gas supply source 115, the heater 116 and the like constitute drying-gas supply means; the drying-gas supply means, the dryer body 111, the cooler 112, the recovery unit 113, the absorber 114 and the like constitute drying means; the pyrolyzer body 121, the cooler 122, the recovery unit 123, the absorber 124 and the like constitute pyrolysis means; and the briquetter 131, the collector container 135 and the like constitute compression-molding means.

Next, a description will be given of a coal reforming method using a coal reforming apparatus 100 according to the present embodiment, which has the above configuration.

When the low-quality coal 1 is supplied to the inside of the dryer body 111 and concurrently the drying gas 101 is supplied from the drying gas supply source 115 to flow through the heater 116, the drying gas 101 is heated (approximately 100° C. to 250° C.), and then supplied to the inside of the dryer body 111 while the radical scavenger 102 is supplied by the radical scavenger supplier 117 (at a ratio of, for example, approximately 5 to 25 wt % relative to the total amount of the radical scavenger 102 and the drying gas (preferably approximately 10 to 20 wt %)). Thereby, the low-quality coal 1 in the dryer body 111 is heated while the inside of the dryer body 111 is turned into a radical-scavenger-containing atmosphere.

By this configuration, in the low-quality coal 1, as for the moisture physically existing on the entire surface including the pores, it is evaporated due to thermal energy and released from the surface. At the same time, as for chemically bound water which is hydrogen-bound to a oxygen-containing functional group (for example, a carboxyl group, a carbonyl group, a hydroxyl group, an alkoxyl group, and the like) and the like existing on the entire surface including the pores, it is readily replaced with the radical scavenger 102, which not only can easily go into a detailed part because of having been turned into a gas form but also has a higher affinity than water, and then released.

Accordingly, in the low-quality coal 1, both chemically and physically-existing moisture therein is released; thus, the moisture content thereof is remarkably reduced. In addition, the radical scavenger 102 exists on the entire surface including the pores; thus, generation of a hydrate is inhibited.

Incidentally, the drying gas 101 supplied for drying the low-quality coal 1 in the dryer body 111 is cooled by the cooler 112 (for example, approximately 60° C. to 80° C.). The radical scavenger 102 in surplus together with the moisture is recovered by the recovery unit 113. Thereafter, the drying gas 101 is purified by the absorber 14 and then discharged to the outside.

The dried coal 2 thus dried and having the radical scavenger 102 introduced into the detailed part is supplied from the dryer body 111 to the pyrolyzer body 121, and then further heated (for example, at 300° C. to 400° C.) to be pyrolyzed, thus generating pyrolysis gas 5. The pyrolysis gas 5 is cooled down by the cooler 122 (for example, to approximately 60° C. to 80° C.) Subsequently, liquid part 5*a* in the pyrolysis gas 5 is recovered by the recovery unit 123, while gas part 5*b* which has not been liquefied is then subjected to a purification process in the absorber 114 and then discharged to the outside.

At this time, the dried coal 2 is pyrolyzed while changing its physical form during the pyrolysis. Accordingly, a cleavage, a condensation and the like of the oxygen-containing functional group and the like occur. Although radicals are generated not only on the surface but also inside, the radical scavenger 102 going even into detailed parts in the drying process scavenges and deactivates the radicals existing not only on the surface but also inside.

Incidentally, pyrolysis oil 6 generated in the pyrolysis is discharged from the pyrolyzer body 121 to the outside to be recovered.

The pyrolyzed coal 3 in which radicals existing not only on the surface thereof but also inside are deactivated after the above-described pyrolysis is supplied to the briquetter 131 to be compression-molded into lumps, turning into a molded coal 4. The molded coal 4 is collected as reformed coal by the collector container 135.

Specifically, in the present embodiment, it is configured that the radical scavenger 102 is supplied into the drying gas 101 in a gas state, the radical scavenger 102 containing an organic compound, having a hydroxyl group (—OH), which is likely to react with radicals and is more organophilic than water; thus, the low-quality coal 1 is dried in the atmosphere including the radical scavenger 102.

Accordingly, the present embodiment enables the following. In the drying process, since the chemically bound water which is hydrogen-bound to the oxygen-containing functional group and the like existing on the entire surface, including pores, of the low-quality coal 1 can readily be replaced with the radical scavenger 102, (1) the dewatering ratio is enhanced significantly; (2) generation of a hydrate is inhibited; and (3) the radical scavenger 102 exists on the entire surface, including the pores, of the low-quality coal 1. Meanwhile, in the pyrolysis process, the radicals which are generated, due to the pyrolysis not only on the surface but also inside are scavenged by the radical scavenger 102 and then deactivated.

According to the present embodiment, (1) radicals can be deactivated while allowing few radicals to exist in the molded coal 4; (2) generation of additional radicals in the molded coal 4 can be significantly suppressed; and (3) even if new radicals are generated in the molded coal 4, they can be deactivated immediately. Therefore, it is possible to readily produce the molded coal 4 in which the possibility of spontaneous ignition is reliably suppressed.

Note that, examples of the radical scavenger 102 containing an organic compound, having a hydroxyl group (—OH), which is likely to react with radicals and is more organophilic than water include: methanol; ethanol; propanol; butanol; phenol; cresol; ethylhydroxybenzene; methylcresol; methlethylphenol; dimethylcresol; naphthol; dihydroxybenzene; and the like.

Second Embodiment

A second embodiment of the coal reforming apparatus according to the present invention will be described based on FIG. 2. However, the same parts as those in the aforementioned first embodiment are denoted by the same reference numerals as those in the case of the aforementioned first embodiment, thereby omitting redundant descriptions thereof to those in the aforementioned first embodiment.

Figure 2:
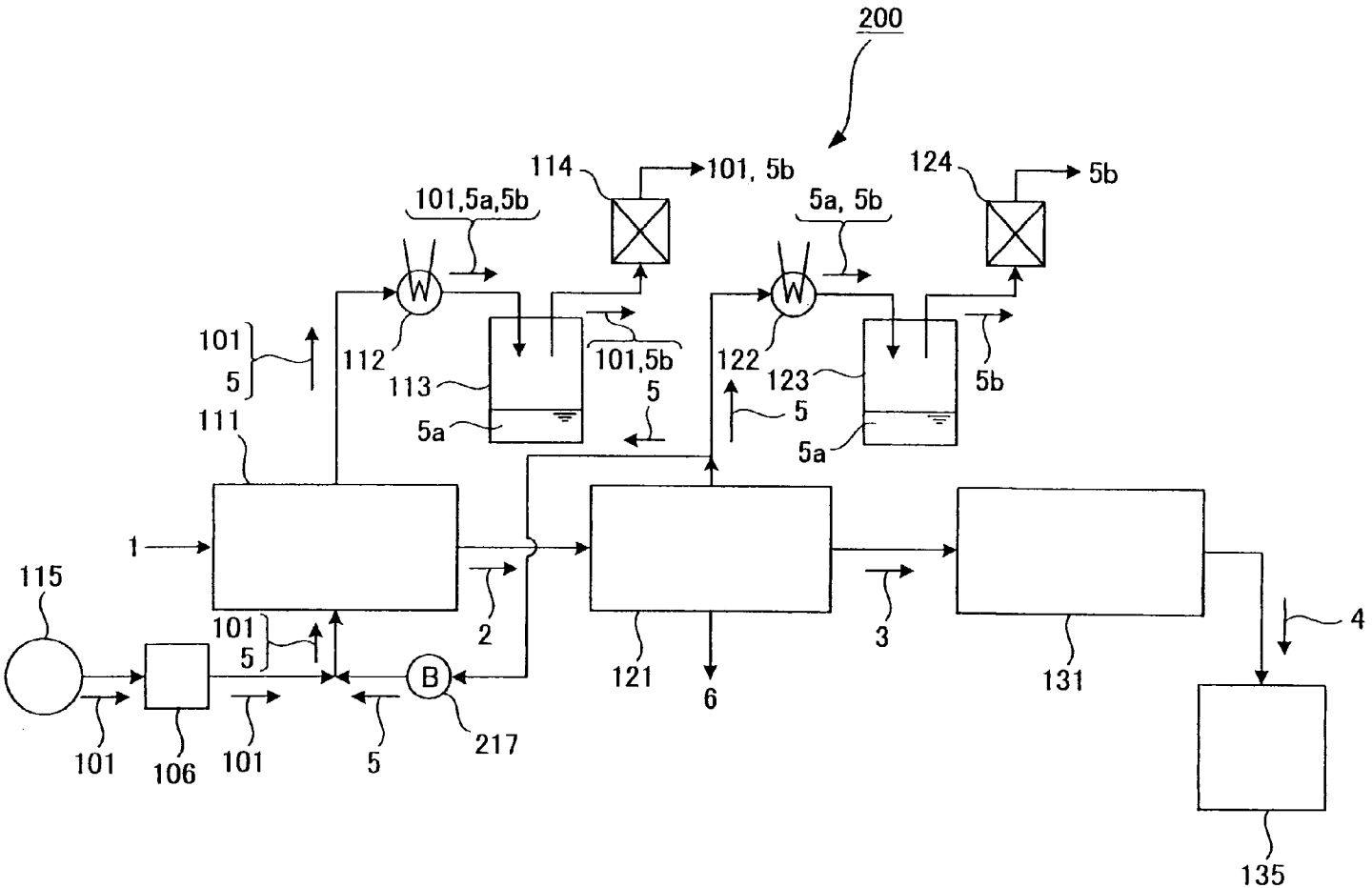
FIG. 2 shows a schematic configuration diagram of a second embodiment of the coal reforming apparatus according to the present invention.

As shown in FIG. 2, a portion between the gas outlet port of the pyrolyzer body 121 and the cooler 122 is connected to a portion between the gas inlet port of the dryer body 111 and the heater 116 with a first supply blower 217 serving as first pyrolysis gas fractionation and supply means interposed in between. The radical scavenger supplier 117 in the aforementioned first embodiment is omitted.

In the present embodiment with such a configuration, the first supply blower 217 and the like constitute first radical-scavenger supply means.

Specifically, in the coal reforming apparatus 100 according to the aforementioned first embodiment, it is configured that the radical scavenger supplier 117 supplies the drying gas 101 with the radical scavenger 102 in a gas state, the radical scavenger 102 containing an organic compound, having a hydroxyl group (—OH), which is likely to react with radicals and is more organophilic than water; thus, the low-quality coal 1 is dried in the atmosphere containing the radical scavenger 102. In contrast, in a coal reforming apparatus 200 according to the present embodiment, part of the pyrolysis gas 5 is fractionated by the first supply blower 217 to be added to the drying gas 101, since the pyrolysis gas 5 contains an organic compound having a hydroxyl group (—OH), such as alcohol and phenol, which is likely to react with radicals and is more organophilic than water.

According to the present embodiment, it is possible not only to obtain the same effect as in the case of the aforementioned first embodiment, but also to utilize the pyrolysis gas 5 as the radical scavenger 102. This eliminates the need for preparing the radical scavenger 102 separately, thus achieving a lower cost than that in the aforementioned first embodiment.

Third Embodiment

A third embodiment of the coal reforming apparatus according to the present invention will be described based on FIG. 3. However, the same parts as those in the aforementioned first and second embodiments are denoted by the same reference numerals in the cases of the aforementioned first and second embodiments, and thereby omitting redundant descriptions thereof to those in the aforementioned first and second embodiments.

Figure 3:
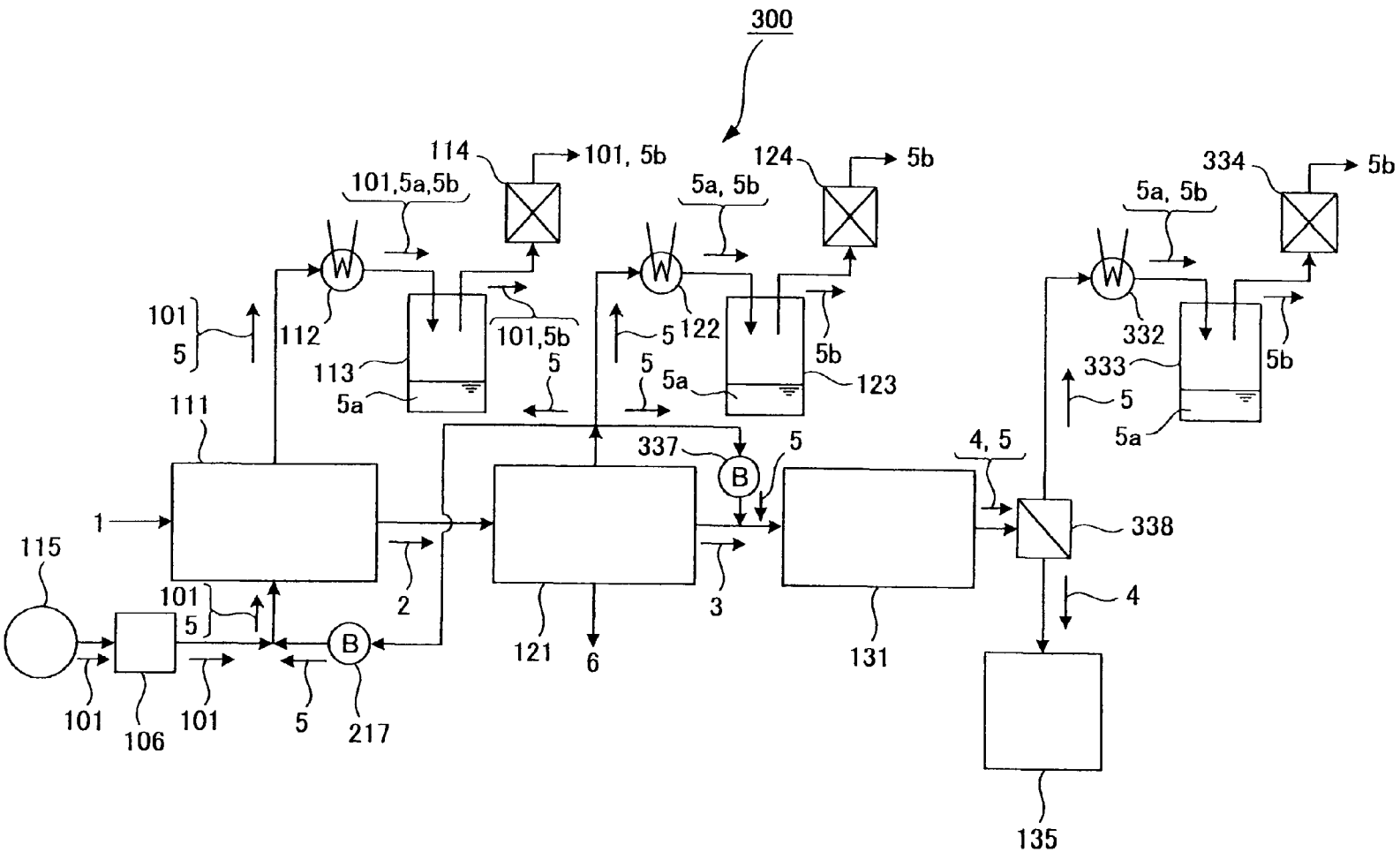
FIG. 3 shows a schematic configuration diagram of a third embodiment of the coal reforming apparatus according to the present invention.

As shown in FIG. 3, a portion between the gas outlet port of the pyrolyzer body 121 and the cooler 122 is connected to the pyrolyzed coal inlet port of the briquetter 131 with a second supply blower 337 serving as second pyrolysis gas fractionation and supply means additionally interposed in between. The molded-coal outlet port of the briquetter 131 is connected to an inlet port of a gas-solid separator 338. As for the gas-solid separator 338, a gas outlet port is connected to the outside with a cooler 332, a recovery unit 333 and an absorber 334 interposed in between, while a solid outlet port is connected to the collector container 135.

In the present embodiment described above, the briquetter 131, the cooler 332, the recovery unit 333, the absorber 334, the collector container 135, the gas-solid separator 338 and the like constitute compression-molding means, and the second supply blower 337 and the like constitute second radical-scavenger supply means.

Specifically, a coal reforming apparatus 300 according to the present embodiment is designed as follows. In the coal reforming apparatus 200 according to the aforementioned second aspect of the invention, part of the pyrolysis gas 5 is further fractionated by the second supply blower 337 to be supplied to the atmosphere inside the briquetter 131.

With this configuration, the coal reforming apparatus 300 according to the present embodiment enables the pyrolysis gas 5 containing the organic compound having a hydroxyl group (—OH) to exist in the atmosphere for the compression-molding of the pyrolyzed coal 3. Thus, it is possible to produce the molded coal 4 by compression-molding of the pyrolyzed coal 3 while allowing the organic compound having the hydroxyl group (—OH) to further go into the molded coal 4.

According to the present embodiment, it is possible not only to obtain the same effect as in the cases of the aforementioned first and second embodiments, but also to allow the organic compound having the hydroxyl group (—OH) to go further into the molded coal 4. Thus, it is possible to readily produce the molded coal 4 in which the possibility of spontaneous ignition is further reliably suppressed.

Other Embodiment

In the aforementioned first and second embodiments, it is configured that the pyrolysis gas 5 is directly supplied from the pyrolyzer body 121 into the drying gas 101 and the briquetter 131, the pyrolysis gas 5 containing an organic compound, having a hydroxyl group (—OH), which is likely to react with radicals and is more organophilic than water. However, as another embodiment, for example, the organic compound, having a hydroxyl group (—OH), which is likely to react with radicals and is more organophilic than water may be isolated by distillation from the liquid part 5*a* of the pyrolysis gas 5 recovered by the recovery unit 123, and then be supplied into the drying gas 101 or the inside atmosphere of the briquetter 131 in a gas state.

INDUSTRIAL APPLICABILITY

The coal reforming apparatus according to the present invention is capable of readily producing reformed coal in which the possibility of spontaneous ignition is reliably suppressed. Therefore, it can be applied to the industry very usefully.

REFERENCE SIGNS LIST

1 LOW-QUALITY COAL (LOW-GRADE COAL)
2 DRIED COAL
3 PYROLYZED COAL
4 MOLDED COAL (REFORMED COAL)
5 PYROLYSIS GAS
5*a* LIQUID PART
5*b* GAS PART
6 PYROLYSIS OIL
100 COAL REFORMING APPARATUS
101 DRYING GAS
102 RADICAL SCAVENGER
111 DRYER BODY
112 COOLER
113 RECOVERY UNIT
114 ABSORBER
115 DRYING GAS SUPPLY SOURCE
116 HEATER
117 RADICAL SCAVENGER SUPPLIER
121 PYROLYZER BODY
122 COOLER
123 RECOVERY UNIT
124 ABSORBER
131 BRIQUETTER
135 COLLECTOR CONTAINER
200 COAL REFORMING APPARATUS
217 FIRST SUPPLY BLOWER
300 COAL REFORMING APPARATUS
332 COOLER
333 RECOVERY UNIT
334 ABSORBER
337 SECOND SUPPLY BLOWER
338 GAS-SOLID SEPARATOR

The invention claimed is:

1. A coal reforming apparatus comprising:
drying means for drying coal;
pyrolysis means for pyrolyzing the dried coal from the drying means;
compression-molding means for compression-molding the pyrolyzed coal from the pyrolysis means, and
first radical-scavenger supply means for supplying an atmosphere in the drying means with a radical scavenger containing an organic compound having a hydroxyl group, so that the coal is dried in the atmosphere containing the radical scavenger.

2. The coal reforming apparatus according to claim 1, wherein
the drying means includes:
a body an inside of which is supplied with the coal; and
drying-gas supply means for supplying the inside of the body with heated drying gas, and
the first radical-scavenger supply means includes the radical scavenger therein, and supplies the drying gas with the radical scavenger so that the drying gas from the drying-gas supply means contains the radical scavenger in a gas state.

3. The coal reforming apparatus according to claim 1, wherein
the drying means includes:
a body an inside of which is supplied with the coal; and
drying-gas supply means for supplying the inside of the body with heated drying gas, and
the first radical-scavenger supply means includes first pyrolysis gas fractionation-supply means for adding at least part of pyrolysis gas to the drying gas, the pyrolysis gas being generated by the pyrolysis means.

4. The coal reforming apparatus according to claim 1, comprising second radical-scavenger supply means for supplying an atmosphere in the compression-molding means with the radical scavenger so that the coal is compression-molded in the atmosphere containing the radical scavenger.

5. The coal reforming apparatus according to claim 4, wherein the second radical-scavenger supply means includes second pyrolysis-gas fractionation and supply means for supplying the compression-molding means with at least part of pyrolysis gas generated by the pyrolysis means.

* * * * *